United States Patent [19]

Choong et al.

[11] Patent Number: 4,666,121

[45] Date of Patent: May 19, 1987

[54] SPRING-TILT MECHANISM FOR A CHAIR OR SEAT

[75] Inventors: John Choong; Geoffrey Hollington, both of London, Great Britain

[73] Assignee: Syba Limited, Billericay, United Kingdom

[21] Appl. No.: 862,045

[22] Filed: May 12, 1986

[30] Foreign Application Priority Data

May 10, 1985 [GB] United Kingdom ..... 8511874

[51] Int. Cl.[4] ..... F16M 13/00

[52] U.S. Cl. ..... 248/575; 248/608; 248/372.1; 297/304

[58] Field of Search ..... 248/372.1, 608, 609, 248/587, 575–577, 371, 566, 560, 590, 596, 636, 584; 297/304; 74/89.15, 89.21, 89.22

[56] References Cited

U.S. PATENT DOCUMENTS 2,845,991 8/1958 Soderberg ..... 248/575
2,889,869 6/1959 Seenberg ..... 248/575
4,235,408 11/1980 Sapper ..... 248/608
4,438,978 3/1984 Arild ..... 248/608

*Primary Examiner*—Reinaldo P. Machado
*Assistant Examiner*—Alvin Chin-Shue
*Attorney, Agent, or Firm*—Rosen, Dainow & Jacobs

[57] ABSTRACT

The spring-tilt mechanism comprises a support frame (4), a seat portion (1) tiltable on the support frame (4) about a substantially horizontal axis (2) between a first and a second position, e.g. defined by stops (13, 13'). One end (15') of a torsion spring (15) is fixed against rotation in the support frame (4). A gear box (16) is operatively engaged with the other end (15'') of the torsion spring (15) and has an extendible member (24) engageable with a tracking surface (31) of the seat portion (1). An operating member (29) on the gear box (17) is easily accessible to a user sitting on the seat portion (1) to pre-load the torsion spring (15) for cushioning the user on the seat portion (1) between the said first and second positions (stops 13, 13').

15 Claims, 4 Drawing Figures

SPRING-TILT MECHANISM FOR A CHAIR OR SEAT

BACKGROUND OF THE INVENTION

1. Field of the Invention

The present invention relates to a spring-tilt mechanism for a chair or seat.

2. Description of the Related Art

It is known to provide a spring-tilt mechanism for a chair or seat, e.g. a typist's chair, in which a seat portion is tiltable against a torsion spring. The pre-loading of the torsion spring is adjusted by means of a screw-threaded handle engaging a stop member. Not only does turning the handle require considerable effort, but the handle is not easily accessible to a person seated on the seat portion; the person must get off the chair to adjust the pre-loading of the torsion spring.

OBJECTS AND SUMMARY OF THE INVENTION

An object of the invention is to provide a spring-tilt mechanism for a chair or seat which is ergonomic and easy to adjust whilst a user is in a normal seated position.

The invention provides a spring-tilt mechanism for a chair or seat comprising a support frame, a seat portion tiltable on the support frame about a substantially horizontal axis between a first and a second position, a torsion spring having two ends, one end of said torsion spring being fixed against rotation in the support frame, a gear box operatively engaged with the other end of said torsion spring and having an extendible member engageable with a tracking surface of the seat portion, and an operating member easily accessible to a user sitting on the seat portion for operating said gear box to extend said extendible member thereby pre-loading the torsion spring for cushioning the user on the seat portion between said first and second positions of the seat portion.

BRIEF DESCRIPTION OF THE DRAWINGS

An embodiment of the invention will now be described with reference to the accompanying drawings, wherein.

DETAILED DESCRIPTION OF THE PREFERRED EMBODIMENT

Figure 1:
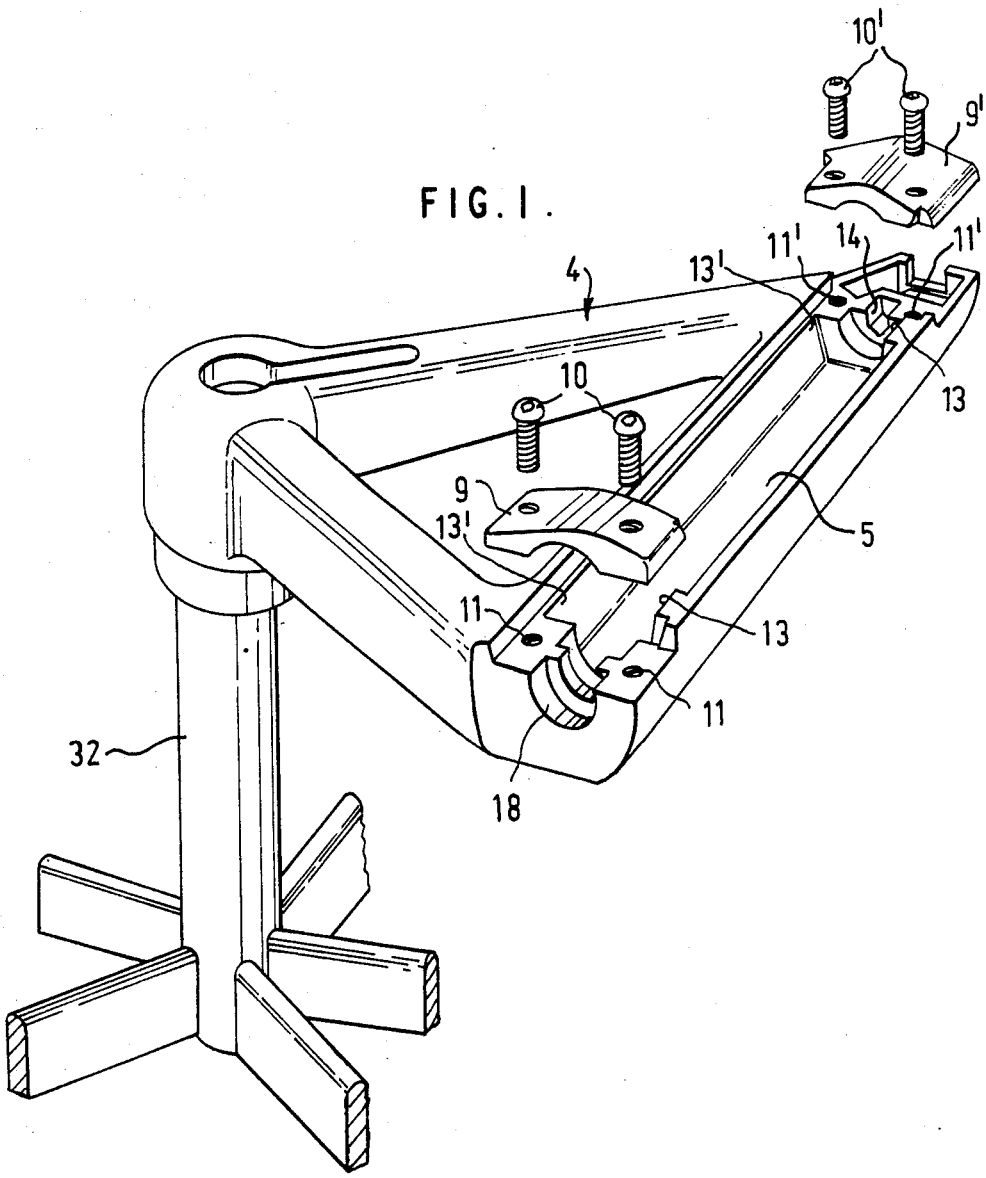
FIG. 1 is a perspective view of a support frame of the spring-tilt mechanism according to the invention.
Figure 2:
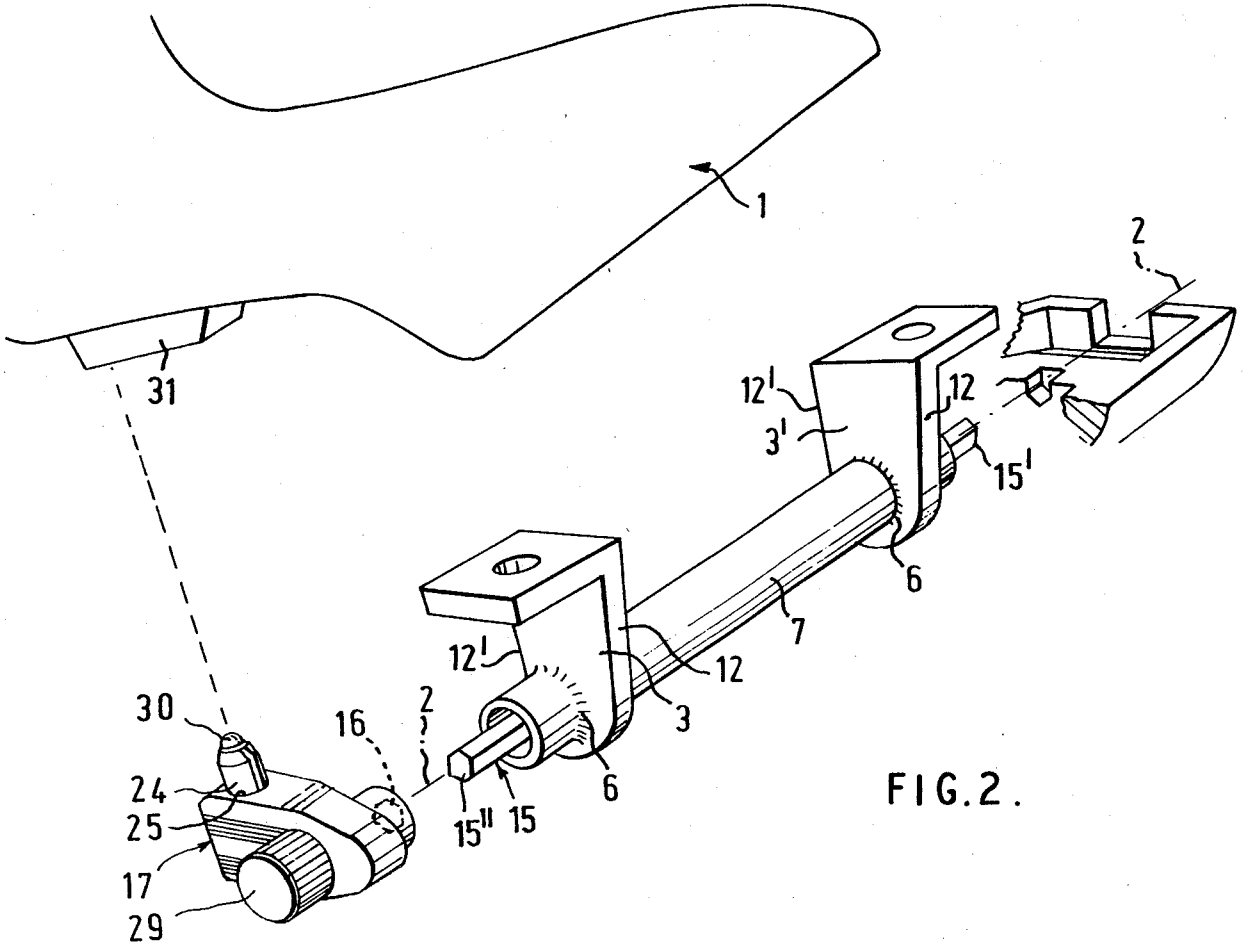
FIG. 2 is an exploded perspective view of the spring-tilt mechanism without the support frame of FIG. 1.
Figure 3:
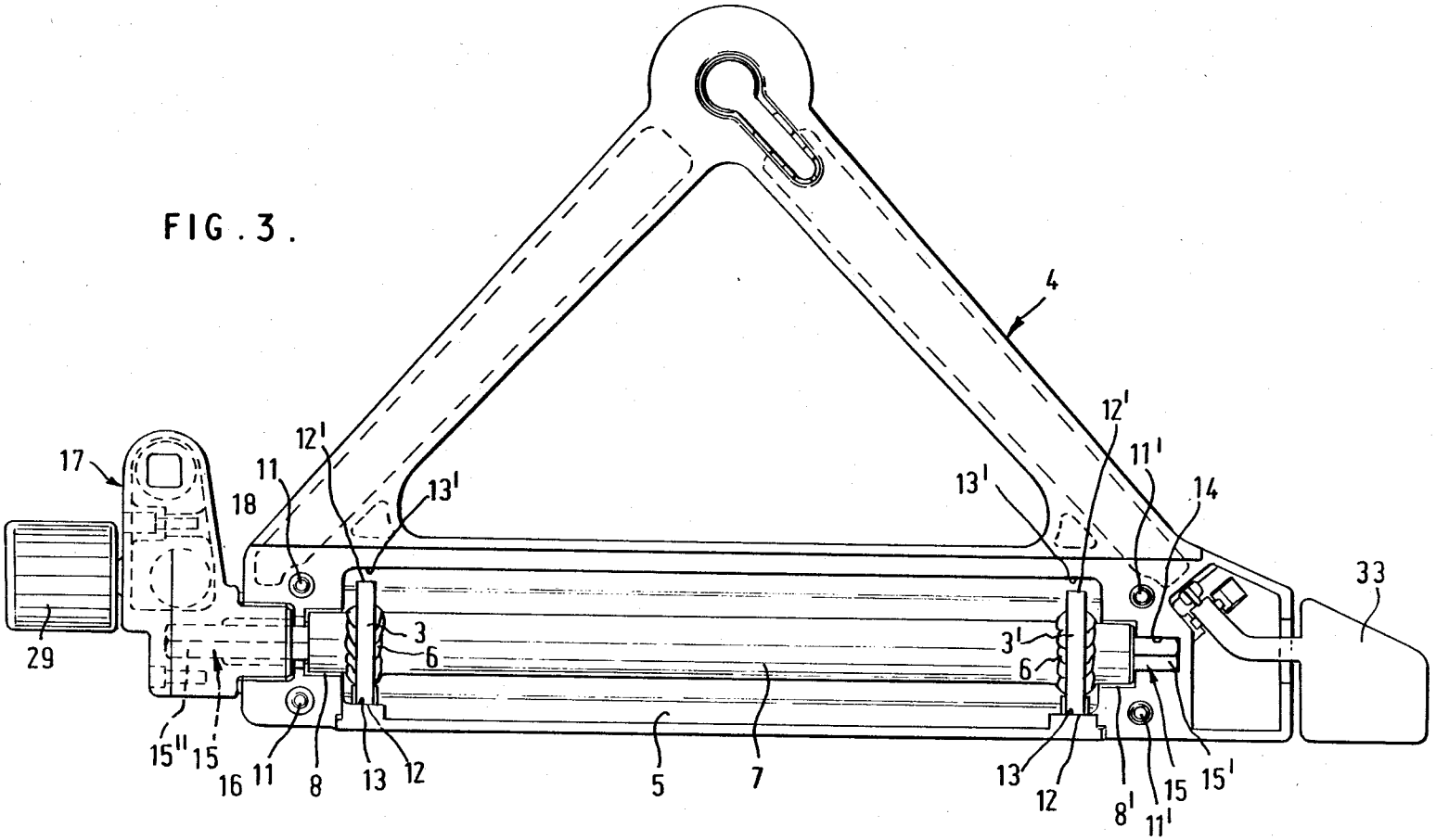
FIG. 3 is a plan part-sectional view of the spring-tilt mechanism of FIG. 2 in place in the support frame, but without the seat portion.

In FIGS. 1 to 3 a spring-tilt mechanism for a chair or seat, e.g. a typist's chair, comprises a seat portion 1 pivotable about a substantially horizontal axis 2 adjacent the front of the seat portion 1. Depending brackets 3, 3' are fixed to the underside of the seat portion 1 and are supported in a substantially triangular-shaped support frame 4 having a front trough 5.

The brackets 3, 3' are attached, e.g. by welds 6, to a tube 7 pivotally mounted in two pivot bushes 8, 8' at ends of the trough 5. The tube 7 is clamped at both ends in the trough 5 by removable covers 9, 9' and screws 10, 10' engaging threaded holes 11, 11' in the support frame 4.

As can be seen from FIGS. 2 and 3 the tube 7 is pivotable in the pivot bushes 8, 8' between two end positions defined by engagement of front and rear faces 12, 12' of the brackets 3, 3' with front and rear stops 13, 13', respectively, in the trough 5.

One end of the trough 5 has a keyed socket 14, e.g. hexagonal shaped, partly defined by a shaped under-surface of the cover 9'. The socket 14 accommodates one end 15' of a correspondingly-shaped torsion bar 15, thereby fixing the end against rotation. The torsion bar 15 passes without contact through the tube 7 and projects beyond the support frame 4. The other end 15" of the torsion bar engages a correspondingly-shaped opening 16 in a gear box 17 mounted externally of the support frame 4 in a pivot bush 18.

Figure 4:
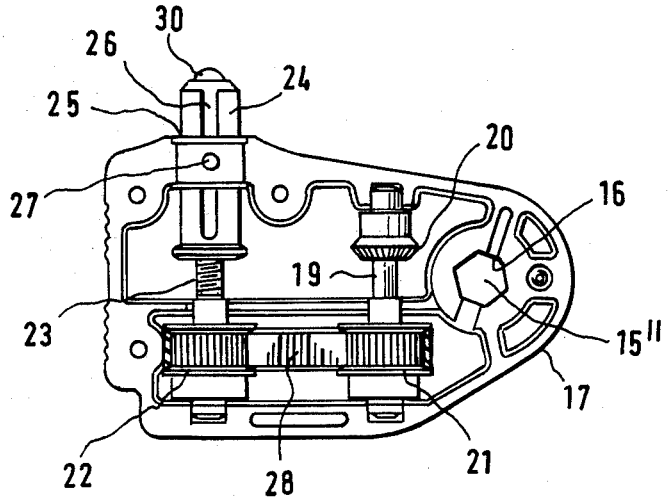
FIG. 4 is an inside view of the gearbox of the spring-tilt mechanism of FIG. 2.

In the gear box 17 (FIG. 4) a first gearing comprises a substantially vertical spindle 19 carrying a bevel gear 20 and a toothed pulley 21. A second gearing comprises a toothed pulley 22 mounted on a substantially vertical spindle 23, one end of which is externally threaded and carries a corresponding internally-threaded push-rod 24 projecting through an aperture 25 in the gear box 17. The push-rod 24 has two diametrically-opposed, longitudinally-extending slots or keyways 26 (only one keyway is shown in FIG. 4) engaged by dowels or pins 27. Thus, the push-rod 24 is held against rotation, but is longitudinally extendible and retractable through the aperture 25, depending on the direction of rotation of the spindle 23.

The pulleys 21, 22 are drivingly interconnected by a toothed belt 28. The gear box 17 has an external actuating knob or handle 29 having a spindle carrying a bevel gear (not shown) drivingly engaged with the bevel gear 20. Thus rotation of the knob 29 in one direction rotates the first gearing, and via the toothed belt 28, the second gearing thereby extending the push-rod 24. Rotation of the knob 29 in the other direction retracts the push-rod 24.

The push-rod 24 has a ball end 30 which engages a thrust pad or track 31 on the underside of the seat portion 1. As the push-rod 24 extends, it tilts the seat portion forwardly about the pivot axis 2 until the front surfaces 12 of the brackets 3, 3' engage the front stops 13. Since the seat portion 1 is thereby prevented from further forward tilting, further rotation of the knob 29 causes the gearbox 17 to turn in the pivot bush 18. The end 15" of the torsion bar 15 is similarly turned about the axis 2 (FIG. 2), thus loading the torsion bar. If the knob 29 is rotated suffuciently, the torsion bar 15 becomes sufficiently pre-loaded so that a person sitting on the seat portion 1 is cushioned.

The weight of the person causes the seat portion 1 to pivot rearwardly against the pre-loading of the torsion bar 15 so that the front surfaces 12 of the brackets 3, 3' move away from the front stops 13. If the torsion bar 15 is not sufficiently pre-loaded, the seat portion 1 will pivot rearwardly until the rear surfaces 12' of the brackets 3, 3' contact the rear stops 13'. The knob 29 should then be turned to increase the pre-loading of the torsion bar 15 so that the seat portion 1 is pivoted to a position in which the brackets 3, 3' are between the front and rear stops 13, 13' and the person's weight is cushioned. The degree of cushioning or hardness of the chair may be altered simply by rotating the knob 29.

It will be seen that positioning the knob 29 externally of the gearbox 17 at the end of the support frame 4 facilitates access and actuation by the person in the chair without excessive effort or difficulty. It is not, for example, necessary for the person to get up from the chair to alter the degree of cushioning.

Various embodiments may be made within the scope of the invention. Thus, the gearings in the gear box 17 may be replaced by any other suitable mechanism, e.g. a rack and pinion. It would be possible to dispense with the first gearing entirely. In this case the bevel gear 20 would be mounted on the spindle 23 in place of the pulley 22.

The torsion rod 15 may be shaped only at the ends 15', 15'', and this shaping can be other than hexagonal. The tube 7 may be replaced by two collars adjacent the respective pivot bushes 8, 8'.

Instead of the slots 26 and pins 27, the push-rod 24 may be provided with a non-circular, e.g. hexagonal, cross-section, and be slidable in a sleeve of corresponding cross-section, thereby preventing rotation. The end of the push-rod 24 may be provided with an integral domed portion instead of the separate ball end 30.

If the axis of rotation of the knob 29 is substantially aligned with the longitudinal axis 2, the orientation of the knob 29 relative to the support frame 4 remains constant. Alternatively, the axis of rotation may be offset with respect to the longitudinal axis 2.

The support frame 4 may be any other suitable shape, e.g. "T" shaped, rectangular, square or box-section, and may be height-adjustably mounted on a standard leg support 32 of a typist's chair. FIG. 3 shows an operating lever 33 of a known gas mechanism. Instead of being pivotable about the front edge of the seat portion, the construction may be reversed so that the seat portion 1 is pivotable about a rear axis. Alternatively, the seat portion 1 may be pivotable about an axis between the front and the rear.

Instead of a standard leg support 32, alternative supports may be used so that the seat or chair may be in the form of an airline seat, a dentist's chair, a vehicle seat (e.g. car or coach), or any other seat or chair in which a cushioned pivoting action is desired.

Clearly the invention may be applied to tilt the back of a seat either along, or together with the horizontal part of the seat portion.

We claim as our invention:

1. A spring-tilt mechanism for a chair or seat comprising a support frame, a seat portion tiltable on the support frame about a substantially horizontal axis between a first and a second position, a torsion spring having two ends, one end of said torsion spring being fixed against rotation in the support frame, a gear box operatively engaged with the other end of said torsion spring and having an extendible member engageable with a tracking surface of the seat portion, and an operating member easily accessible to a user sitting on the seat portion for operating said gear box to extend said extendible member thereby pre-loading the torsion spring for cushioning the user on the seat portion between said first and second positions of the seat portion.

2. A spring-tilt mechanism according to claim 1, wherein said support frame comprises a substantially triangular-shaped member adjustably attached at one apex to a vertical support of a chair or seat.

3. A spring-tilt mechanism according to claim 1, wherein said tilting axis of said seat portion is adjacent a front edge thereof.

4. A spring-tilt mechanism according to claim 1, wherein said operating member is a rotatable knob or handle on said gear box.

5. A spring-tilt mechanism according to claim 4, wherein said knob or handle has an axis of rotation substantially coinciding with the longitudinal axis of said torsion spring.

6. A spring-tilt mechanism according to claim 1 wherein said extendible member comprises a threaded push-rod engaged by a threaded spindle of said gear box, said push-rod being axially movable on rotation of said threaded spindle caused by actuation of said operating member.

7. A spring-tilt mechanism according to claim 6, wherein said gear box comprises a first gearing in driving engagement with the operating member, and a second gearing drivingly connected to said first gearing and to said threaded spindle.

8. A spring-tilt mechanism according to claim 7, wherein said first and second gearings each comprise a toothed pulley, the pulleys being drivingly interconnected by toothed belting.

9. A spring-tilt mechanism according to claim 7, wherein said first gearing comprises a bevel gear engaged with a bevel gear connected to said operating member.

10. A spring-tilt mechanism according to claim 6, wherein said gear box comprises a gearing in driving engagement with the operating member and mounted on said threaded spindle.

11. A spring-tilt mechanism according to claim 1, wherein said seat portion is tiltable on said support frame via depending brackets.

12. A spring-tilt mechanism according to claim 11, wherein said depending brackets are pivotable against stops of said support frame providing said said first and second positions.

13. A spring-tilt mechanism according to claim 11, wherein said brackets are mounted on tubular means, said torsion spring passing through said tubular means.

14. A spring-tilt mechanism according to claim 13, wherein said tubular means comprises a single hollow tube, said brackets being attached to said hollow tube.

15. A chair or seat having a spring-tilt mechanism comprising a support frame, a seat portion tiltable on the support frame about a substantially horizontal axis between a first and a second position, a torsion spring having two ends, one end of said torsion spring being fixed against rotation in the support frame, a gear box operatively engaged with the other end of said torsion spring and having an extendible member engageable with a tracking surface of the seat portion, and an operating member easily accessible to a user sitting on the seat portion for operating said gear box to extend said extendible member thereby pre-loading the torsion spring for cushioning the user on the seat portion between said first and second positions of the seat portion.

* * * * *